US008911198B2

(12) United States Patent
Moon

(10) Patent No.: US 8,911,198 B2
(45) Date of Patent: Dec. 16, 2014

(54) APPARATUS FOR TURNING STEEL PRODUCTS

(71) Applicant: Hyundai Steel Company, Incheon (KR)

(72) Inventor: Sang Pil Moon, Gyeongbuk (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 13/751,894

(22) Filed: Jan. 28, 2013

(65) Prior Publication Data

US 2013/0142611 A1 Jun. 6, 2013

Related U.S. Application Data

(63) Continuation of application No. PCT/KR2011/005562, filed on Jul. 28, 2011.

(30) Foreign Application Priority Data

Jul. 29, 2010 (KR) ..... 10-2010-0073142
Jul. 22, 2011 (KR) ..... 10-2011-0072967

(51) Int. Cl.
*B21B 39/22* (2006.01)
*B21D 43/00* (2006.01)
*B21B 39/20* (2006.01)

(52) U.S. Cl.
CPC ..... *B21D 43/003* (2013.01); *B21B 39/20* (2013.01)
USPC ..... 414/774; 414/758; 192/69.62

(58) Field of Classification Search
CPC .. B65G 47/244; B65G 47/248; B65G 47/252; B65G 2201/0217; B65G 2201/022; B65G 2201/0223; B21D 43/003; B21B 39/20
USPC ..... 414/774, 754, 758, 759; 192/69.62
See application file for complete search history.

(56) References Cited

U.S. PATENT DOCUMENTS

| | | | | | |
|---|---|---|---|---|---|
| 456,827 | A * | 7/1891 | Johnson | 192/99 S |
| 809,997 | A * | 1/1906 | Stevens | 414/754 |
| 1,047,801 | A * | 12/1912 | Haney | 192/69.62 |
| 1,407,115 | A * | 2/1922 | Bailey | 192/18 R |
| 2,206,766 | A * | 7/1940 | Cushnie | 198/478.1 |
| 2,238,434 | A * | 4/1941 | Oberhoffken | 409/138 |
| 3,306,427 | A * | 2/1967 | Spencer | 198/404 |
| 3,319,804 | A * | 5/1967 | Beatty et al. | 414/759 |
| 3,552,538 | A * | 1/1971 | Triggs et al. | 198/403 |
| 3,738,143 | A * | 6/1973 | Orris | 414/754 |
| 6,446,785 | B1 * | 9/2002 | Tremblay | 198/404 |
| 6,557,692 | B2 * | 5/2003 | Runonen | 198/403 |
| 7,607,370 | B2 * | 10/2009 | Day et al. | 74/594.1 |
| 2008/0232945 | A1 * | 9/2008 | Holodryga et al. | 414/783 |
| 2011/0106293 | A1 * | 5/2011 | Croghan | 700/213 |

FOREIGN PATENT DOCUMENTS

| | | | |
|---|---|---|---|
| JP | 1997-077249 | C | 3/1997 |
| JP | 2002-205109 | A | 7/2002 |
| KR | 10-0821195 | B1 | 4/2008 |
| KR | 20-2010-0003673 | | 4/2010 |

* cited by examiner

*Primary Examiner* — Saul Rodriguez
*Assistant Examiner* — Lynn Schwenning
(74) *Attorney, Agent, or Firm* — Edwards Wildman Palmer LLP; Peter F. Corless

(57) ABSTRACT

The present invention relates to an apparatus for turning steel products. The apparatus comprises a rotating shaft, a first turning plate, and a second turning plate. The first turning plate is fixedly mounted to the rotating shaft with a longitudinal axis of the first turning plate perpendicular to a longitudinal axis of the rotating shaft. The second turning plate is movably mounted to the rotating shaft with a longitudinal axis of the second turning plate perpendicular to a longitudinal axis of the rotating shaft.

9 Claims, 9 Drawing Sheets

APPARATUS FOR TURNING STEEL PRODUCTS

CROSS-REFERENCE TO RELATED APPLICATIONS

This is a continuation of International Application No. PCT/KR2011/005562 filed on Jul. 28, 2011, which claims priority to Korean Application No. 10-2010-0073142 filed on Jul. 29, 2010 and Korean Application No. 10-2011-0072967 filed on Jul. 22, 2011, which applications are incorporated herein by reference.

TECHNICAL FIELD

The present invention relates, in general, to apparatuses for turning steel products and, more particularly, to apparatuses for turning a steel product such as equilateral L-shape, inequilateral L-shape, I-shape, or H-shape steel products.

BACKGROUND ART

Generally, in iron-foundry plants, rolling processes are conducted to produce rolled substances. A rolling process includes inserting a slab, a bloom, or a billet, etc., which has been formed by a continuous casting process, into a space between rollers, thus forming it into a variety of shapes.

Shape steel is structural rolled steel, referring to a rod-shaped rolled substance having various shapes, and is mainly used to form a steel frame structure. Such shape steel is produced in such a way that molten steel is poured into a rectangular cylindrical mold to form a steel ingot, impurities are removed from the steel ingot to make it dense, the steel ingot is re-heated in a heating furnace and introduced into a rolling mill, and then processed by subjecting it to several steps of rolling.

Shape steel is classified into equilateral L-shape steel, inequilateral L-shape steel, H-shape steel, I-shape steel, U-shape steel, Z-shape steel, T-shape steel, etc.

Shape steel is placed onto a chain conveyor by a turning apparatus and transferred to a subsequent processing area while being cooled.

SUMMARY

Accordingly, the present invention has been made keeping in mind the above problems occurring in the prior art, and an object of the present invention is to provide a steel product turning apparatus which can appropriately change its structure depending on the shape of a steel product (shape steel) so that the operation of turning the steel product can be effectively conducted.

The object of the present invention is not limited to the above-mentioned object. Other objects of the present invention will be clearly understood by those skilled in this art from the following description.

In order to accomplish the objects, the present invention provides an apparatus for turning steel products, including: a rotating shaft; a first turning plate fixedly mounted to the rotating shaft with a longitudinal axis of the first turning plate perpendicular to a longitudinal axis of the rotating shaft, such that the first turning plate can rotate along with the rotating shaft; and a second turning plate movably mounted to the rotating shaft with a longitudinal axis of the second turning plate perpendicular to a longitudinal axis of the rotating shaft, such that the second turning plate can move on the rotating shaft forwardly or backwardly in a longitudinal direction of the rotating shaft.

One of the first turning plate and the second turning plate may be provided with one or more insert protrusions at a predetermined position or positions and the other of the first turning plate and the second turning plate may be provided with one or more insert holes at a position or positions corresponding to the predetermined position or positions such that the first turning plate can be coupled to or uncoupled from the second turning plate by engagement or disengagement between the one or more insert protrusions and the one or more insert holes.

One of the first turning plate and the second turning plate may be provided with two insert protrusions spaced apart in a row and the other of the first turning plate and the second turning plate may be provided with four insert holes, first two of which insert holes may be spaced apart in a row, the other two of which insert holes may be spaced apart in a row perpendicular to the row of the first two, such that the first turning plate and the second turning plate can be coupled to be perpendicular or parallel to each other.

The second turning plate may be rotatably installed on a movable member that is provided on the rotating shaft and can move on the rotating shaft forwardly or backwardly in a longitudinal direction of the rotating shaft, whereby the second turning plate can move on the rotating shaft forwardly or backwardly in the longitudinal direction of the rotating shaft.

The movable member may be moved on the rotating shaft by at least one of a hydraulic force, a pneumatic force, and mechanical force.

The first turning plate, the second turning plate, the insert protrusion, the insert hole and the movable member may form a set, wherein the set may comprise a plurality of sets provided on the rotating shaft.

The rotating shaft may include multiple sections, each of the multiple sections configured to be rotated independently.

The apparatus may further including a support for supporting the rotating shaft.

As described above, the present invention can change its structure depending on the shape of a steel product. Therefore, the operation of turning the steel product can be effectively conducted. Thereby, the workability and productivity can be markedly enhanced.

DETAILED DESCRIPTION

Figure 1:
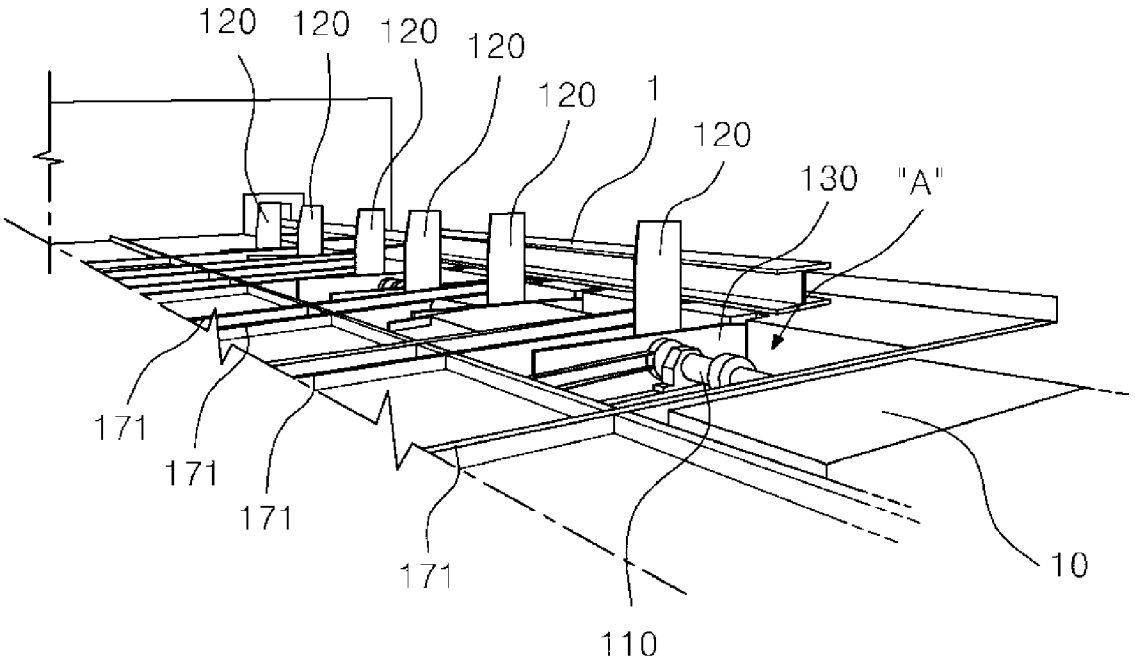
FIG. 1 is a view illustrating a steel product turning apparatus installed in a roller table, according to an embodiment of the present invention.

Hereinafter, embodiments of the present invention will be described with reference to the attached drawings. Reference should now be made to the drawings, in which the same reference numerals are used throughout the different drawings to designate the same or similar components. If, in the specification, detailed descriptions of well-known functions or configurations would unnecessarily obfuscate the gist of the present invention, the detailed descriptions will be omitted.

FIG. 1 is a view illustrating an apparatus for turning steel products according to an embodiment of the present invention. The steel product turning apparatus includes a rotating shaft 110, first turning plates 120 and second turning plates 130.

The rotating shaft 110 is oriented in a direction in which a steel product 1 is transferred by a roller table 10. The roller table 10 rotates rollers, which are provided in a table at positions spaced apart from each other, and transfers the steel product 1, which has been rolled, such as equilateral L-shape steel, inequilateral L-shape steel, H-shape steel, I-shape steel, U-shape steel, Z-shape steel, T-shape steel, etc. in the longitudinal direction of the rotating shaft 110.

Figure 2:
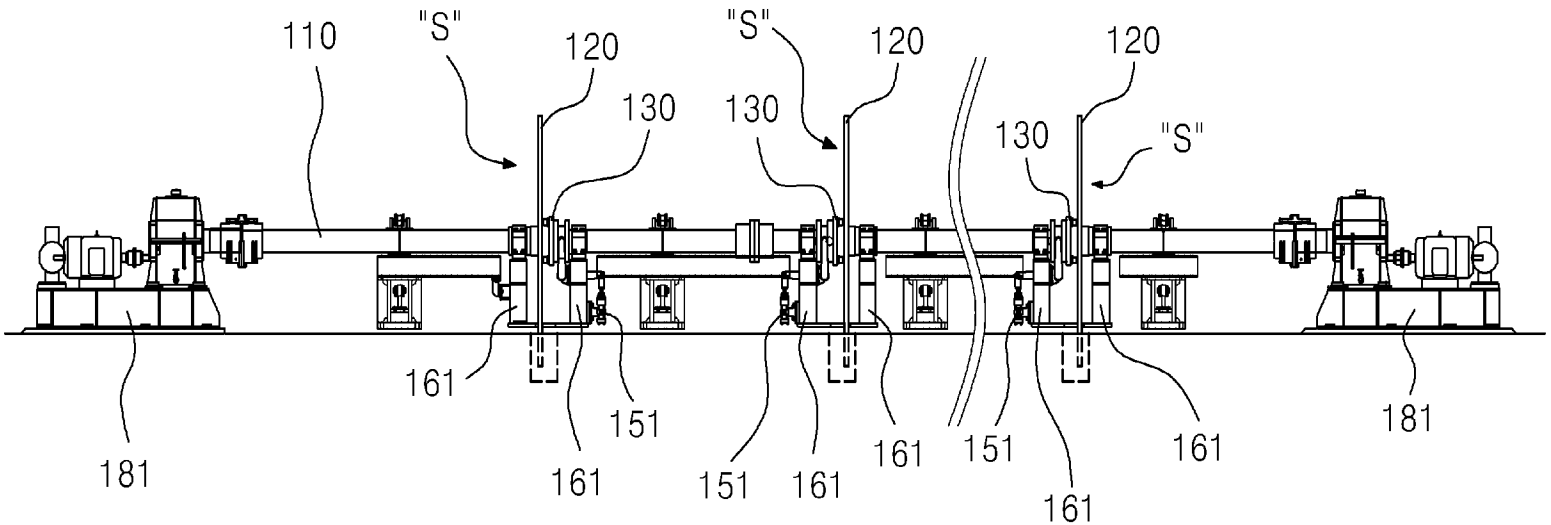
FIG. 2 is a view showing the steel product turning apparatus according to the embodiment of the present invention.

In some embodiments, as shown in FIG. 2, each first turning plate 120 and the corresponding second turning plate 130 may form one set S. A plurality of sets S are arranged along the rotating shaft 110 to effectively turn the steel product 1 having a predetermined length.

Figure 3:
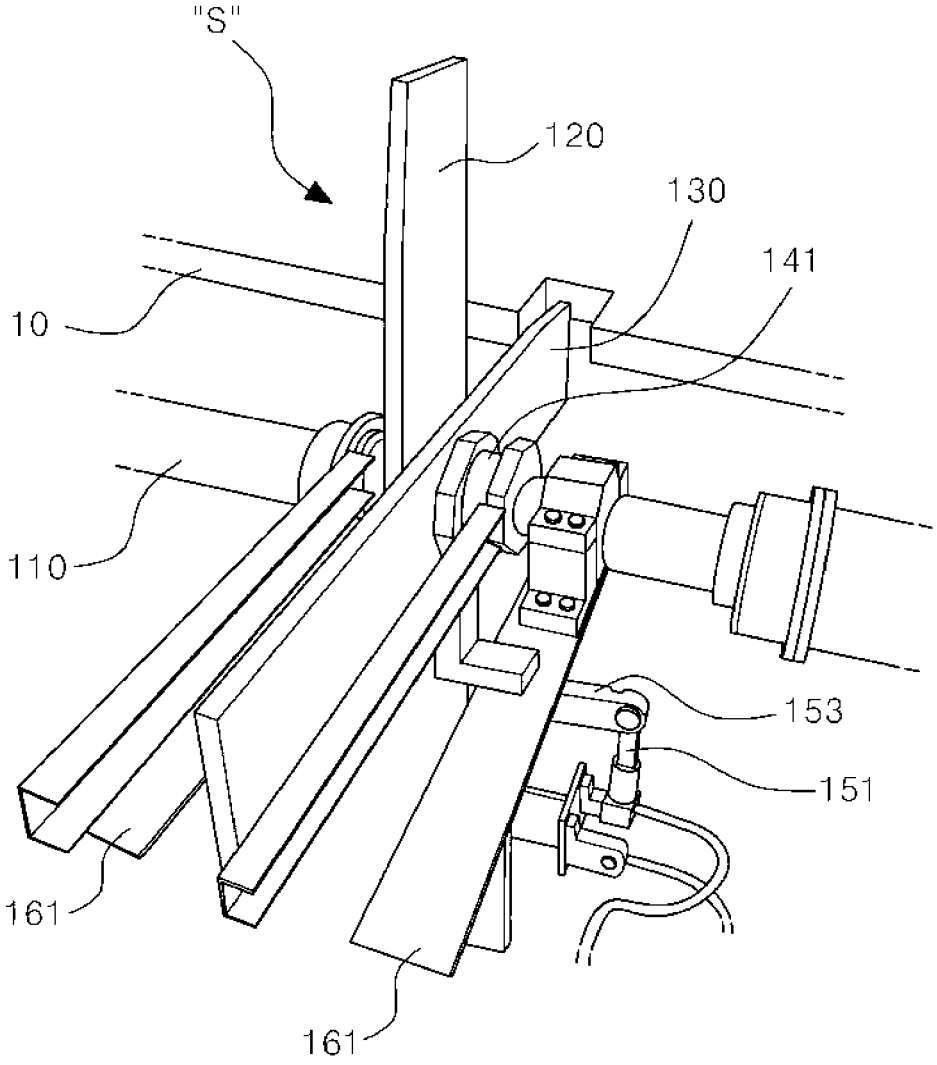
FIG. 3 is an enlarged view of portion A of FIG. 1.

As shown in FIG. 3, the first turning plates 120 are fixed on the rotating shaft 110 and rotated along with the rotating shaft 110. The rotating shaft 110 passes through medial portions of the first turning plates 120 and is firmly fixed thereto.

The second turning plates 130 are provided in the lateral direction of the rotating shaft 110 such that they are perpendicular to the rotating shaft 110. Each second turning plate 130 moves to the left or the right along the rotating shaft 110. Each second turning plate 130 is coupled to the corresponding first turning plate 120 and is rotated along with the first turning plate 120.

The first turning plate 120 and the second turning plate 130 have, at corresponding positions, insert holes 121, 122, 123 and 124 and insert protrusions 131 and 132 which are removably inserted into the insert holes 121, 122, 123 and 124. The first turning plate 120 is coupled to the second turning plate 130 by inserting the insert protrusions 131 and 132 into the insert hole 121, 122, 123 and 124.

Figure 4:
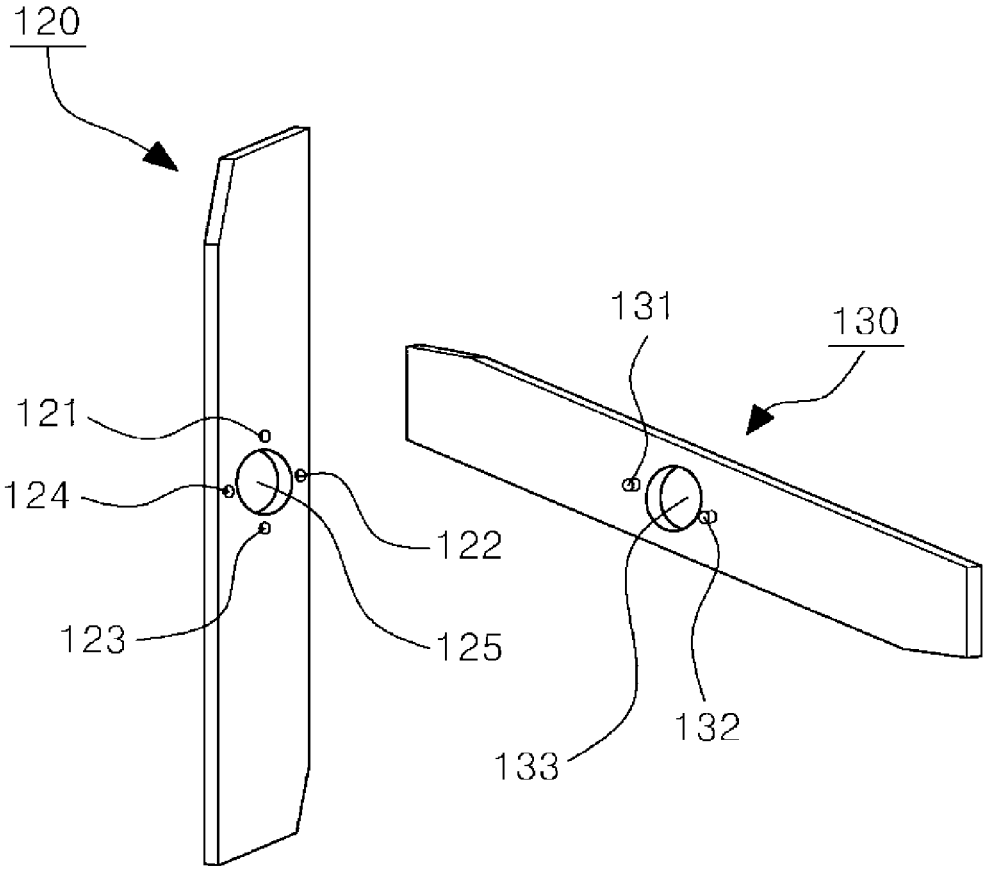
FIG. 4 is an exploded perspective view showing a first turning plate and a second turning plate according to the present invention.

In some embodiments, for example, the insert holes 121, 122, 123 and 124 may be formed in the first turning plate 120, and the insert protrusions 131 and 132 may be provided on the second turning plate 130, as shown in FIG. 4.

Here, the four insert holes 121, 122, 123 and 124 are formed at positions corresponding to the four directions. The two insert protrusions 131 and 132 are disposed in a row. In detail, the four insert holes 121, 122, 123 and 124 are formed at positions spaced apart from each other at intervals of 90° around a through hole 125, in which the rotating shaft 110 is disposed. The two insert protrusions 131 and 132 are provided in a row along the length of the second turning plate 130 on opposite sides of a through hole 133, in which the rotating shaft 110 is disposed.

When the insert protrusions 131 and 132 are respectively inserted into the insert holes 122 and 124 that are arranged in the lateral direction of the first turning plate 120, the first turning plate 120 and the second turning plate 130 are coupled to each other to have a crisscross shape. When the insert protrusions 131 and 132 are respectively inserted into the insert holes 121 and 123 that are arranged in the longitudinal direction of the first turning plate 120, the first turning plate 120 and the second turning plate 130 are coupled parallel to each other to have a shape of numeral 11.

Each second turning plate 130 is installed on a corresponding cylindrical movable member 141 which is movably provided on the rotating shaft 110, so that the second turning plate 130 can move relative to the rotating shaft 110. Furthermore, the second turning plate 130 is rotatably provided on the cylindrical movable member 141 so that it can rotate along with the first turning plate 120. For instance, a bearing may be interposed between the second turning plate 130 and the movable member 141 to enable the second turning plate 130 to rotate relative to the movable member 141. The movable member 141 is moved to the left or the right along the rotating shaft 110 by hydraulic pressure, pneumatic pressure or rotational force of a motor.

Referring to FIG. 3, two arms 153 and 155 which are rotatably connected to each other by a hinge connect the movable member 141 to a cylinder 151 which is operated by pneumatic pressure or hydraulic pressure. The arms 153 and 155 are folded or stretched by extension or contraction of the cylinder 151, whereby the movable member 141 is moved to the left or the right.

In some embodiments, although it is not shown in the drawings, the movable member 141 may be connected to a motor by a gear train. In this case, when the motor rotates in the normal or reverse direction, the movable member 141 is moved to the left or the right.

Figure 5:
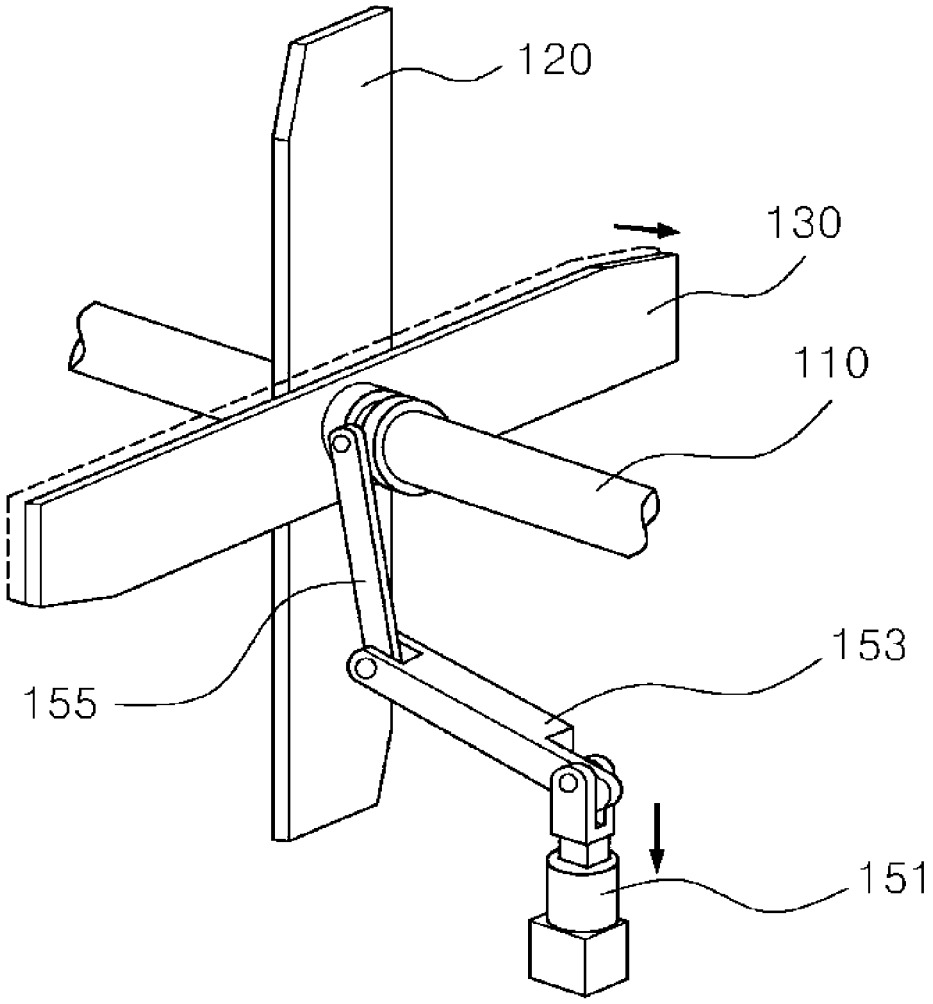
FIGS. 5 through 7 are views successively showing the operation principle of the present invention.

As shown in FIG. 5, conversion of the crisscross coupled state of the first and second turning plates 120 and 130 into the 11-shaped coupled state begins by stopping the rotating shaft 110 that is rotating to conduct the turning operation.

When the rotation of the rotating shaft 110 is stopped, hydraulic pressure, pneumatic pressure or rotational force of the motor is applied to the movable member 141. Thereby, the movable member 141 moves away from the first turning plate 120. Then, the insert protrusions 131 and 132 are removed from the insert holes 122 and 124, so that the second turning plate 130 is separated from the first turning plate 120.

Figure 6:
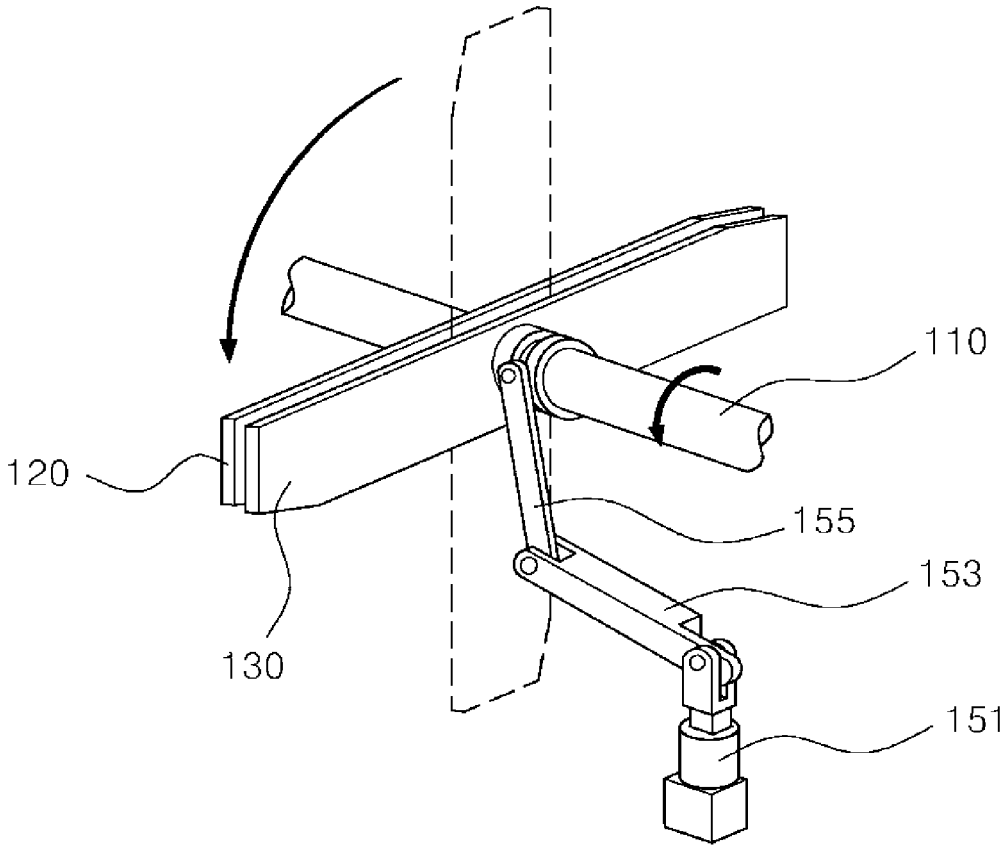

As shown in FIG. 6, after the second turning plate 130 is separated from the first turning plate 120, the rotating shaft 110 is rotated so that the first turning plate 120 that has been vertically oriented enters a horizontal state. The rotating shaft 110 rotates until the first turning plate 120 and the second turning plate 130 form a shape of numeral 11. In other words, the rotating shaft 110 rotates until the insert protrusions 131 and 132 respectively face the insert holes 121 and 123.

Figure 7:
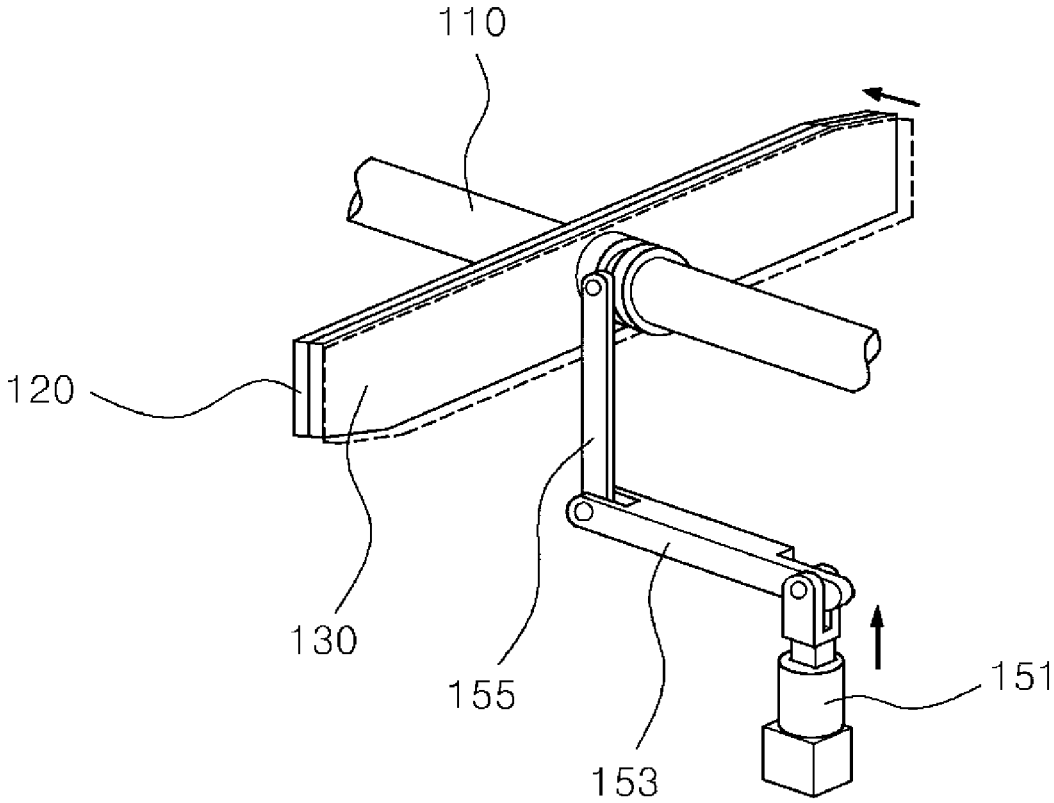

As shown in FIG. 7, after the first turning plate 120 and the second turning plate 130 form a shape of numeral 11, hydraulic pressure, pneumatic pressure or rotational force of the motor is applied to the movable member 141. Thereby, the movable member 141 is moved towards the first turning plate 120. Then, the insert protrusions 131 and 132 are respectively inserted to the insert holes 121 and 123 so that the second turning plate 130 is coupled to the first turning plate 120.

In the process of FIG. 6, if the rotating shaft 110 is rotated to orient the first turning plate 120 in the vertical direction such that the insert protrusions 131 and 132 respectively face the insert holes 122 and 124, the 11-shaped coupled state is converted into the crisscross coupled state.

After the first turning plate 120 and the second turning plate 130 are coupled to each other in a crisscross shape or a shape of numeral 11, the rotating shaft 110 rotates to turn the steel product 1. In the case where the steel product 1 is H-shape steel, the first turning plate 120 and the second turning plate 130 form the crisscross shape and turn the steel product 1.

In the case where the steel product 1 is inequilateral shape steel, such as inequilateral L-shape steel, or inequality-sign-shape steel which has a structure that makes the turning operation difficult, the first turning plate 120 and the second turning plate 130 form a shape of numeral 11 and stop to allow the steel product 1 to pass over the first turning plate 120 and the second turning plate 130.

As such, the structure which couples the first turning plate 120 and the second turning plate 130 to each other can be changed depending on the shape of the steel product 1 before the turning operation is conducted. Therefore, the turning operation can be effectively conducted, thus markedly enhancing the workability and productivity.

Referring to FIG. 3, supports 161 are provided on a base surface and disposed on opposite sides of the first and second turning plates 120 and 130. The rotating shaft 110 is installed in such a way that it passes through the supports 161, thus being supported by the supports 161. Each support 161 has a bearing in a portion through which the rotating shaft 110 passes, so that the rotating shaft 110 can be smoothly rotated.

Referring to FIG. 1, chain conveyors 171 are installed among the sets S including the first and second turning plates 120 and 130. The chain conveyors 171 transfer the steel product 1, which has been transferred by the roller table 10, to the first and second turning plates 120 and 130. The chain conveyors 171 receive the steel product 1, which has been turned by the first and second turning plates 120 and 130, and transfer the steel product 1 to a target location.

The roller table 10 is moved downwards before the chain conveyors 171 are operated, so that the steel product 1 can be smoothly placed onto the chain conveyors 171 and then be transferred by the chain conveyors 171.

Referring to FIG. 2, the rotating shaft 110 is rotated by power of a drive unit 181 which includes a motor and is connected to an end of the rotating shaft 110. The rotating shaft 110 may be divided into two parts. The two parts of the rotating shaft 110 may be respectively connected to two drive units 181 so that they are separately rotated by power of the two drive units 181.

Figure 8:
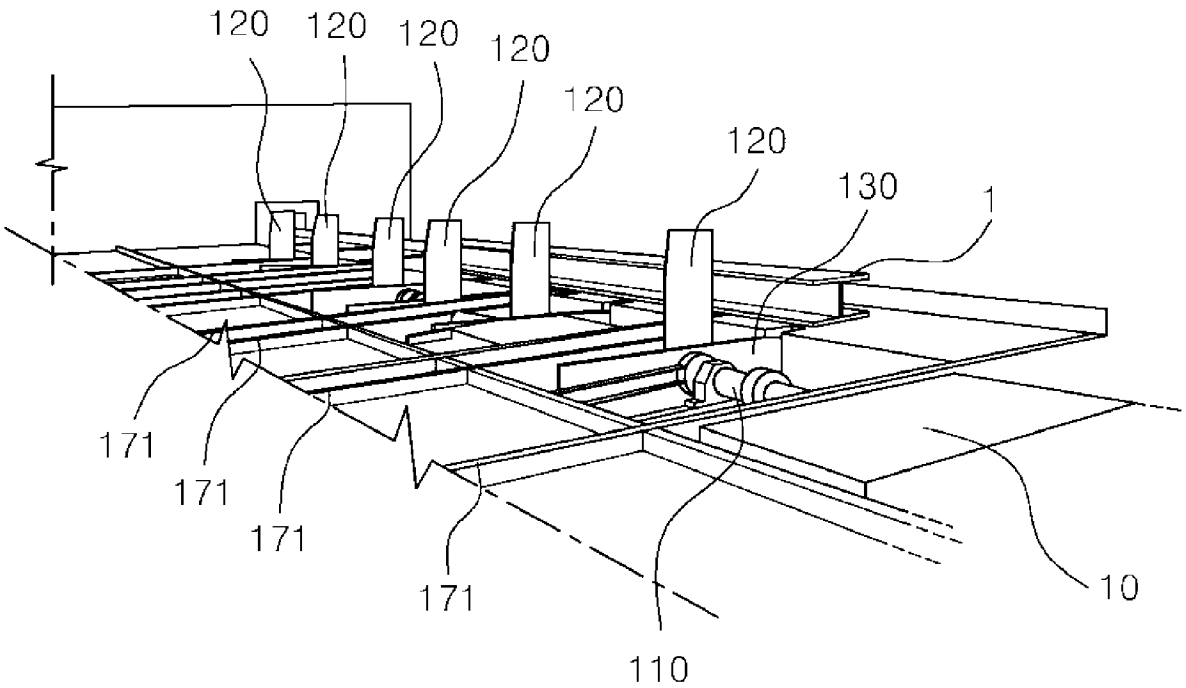
FIG. 8 is a view showing the operation of turning comparatively long H-shape steel using the steel product turning apparatus according to the present invention.
Figure 9:
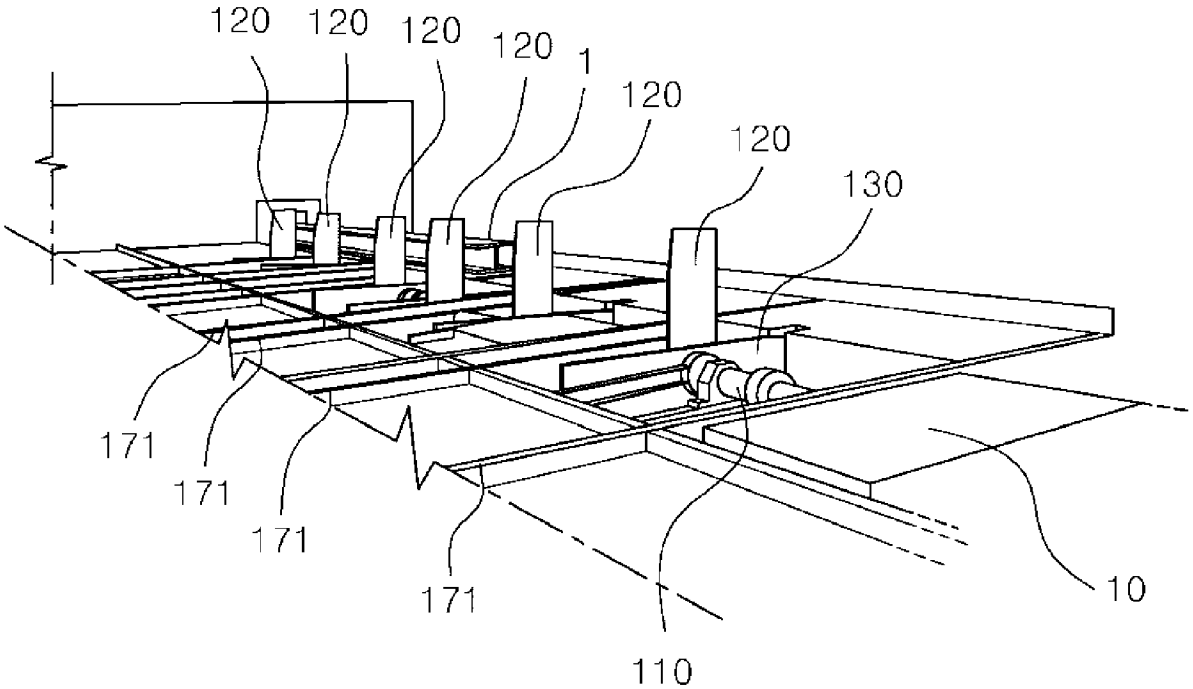
FIG. 9 is a view showing the operation of turning comparatively short H-shape steel using the steel product turning apparatus according to the present invention.

As shown in FIG. 8, in the case where the steel product 1 is comparatively long, the two parts of the rotating shaft 110 are operated at the same time to turn the steel product 1. As shown in FIG. 9, in the case where the steel product 1 is comparatively short, either of the two parts of the rotating shaft 110 is operated to turn the steel product 1. Further, the two parts of the rotating shaft 110 may be independently operated to turn steel products 1.

As such, the rotating shaft 110 is divided into several parts and is operated in such a way that the several parts are selectively operated depending on the length of the steel product 1, thus enhancing the work efficiency, thereby reducing energy consumption.

Although embodiments of the present invention has been disclosed, those skilled in the art will appreciate that various modifications, additions and substitutions are possible, without departing from the scope and spirit of the invention. The scope of the present invention must be defined by the accompanying claims, and all technical spirits that are in the equivalent range to the claims must be regarded as falling within the scope of the present invention.

The invention claimed is:

1. An apparatus for turning steel products, comprising:

a rotating shaft;

a first turning plate fixedly mounted at a medial portion of the first turning plate to the rotating shaft with a longitudinal axis of the first turning plate perpendicular to a longitudinal axis of the rotating shaft, such that the first turning plate can rotate along with the rotating shaft; and a second turning plate movably mounted to the rotating shaft with a longitudinal axis of the second turning plate perpendicular to a longitudinal axis of the rotating shaft, such that the second turning plate can move on the rotating shaft forwardly or backwardly in a longitudinal direction of the rotating shaft, wherein the second turning plate forms a crisscross shape by being coupled to the first turning plate and forms a parallel shape by being decoupled from the first turning plate, wherein in the parallel shape the first turning plate and second turning plate face each other.

2. The apparatus according to claim 1, wherein one of the first turning plate and the second turning plate is provided with one or more insert protrusions at a predetermined position or positions and the other of the first turning plate and the second turning plate is provided with one or more insert holes at a position or positions corresponding to the predetermined position or positions such that the first turning plate can be coupled to or uncoupled from the second turning plate by engagement or disengagement between the one or more insert protrusions and the one or more insert holes.

3. The apparatus according to claim 2, wherein one of the first turning plate and the second turning plate is provided with two insert protrusions spaced apart in a row and the other of the first turning plate and the second turning plate is provided with four insert holes, first two of which insert holes are spaced apart in a row, the other two of which insert holes are spaced apart in a row perpendicular to the row of the first two, such that the first turning plate and the second turning plate can be coupled to be perpendicular or parallel to each other.

4. The apparatus according to claim 1, wherein the second turning plate is rotatably installed on a movable member that is provided on the rotating shaft and can move on the rotating shaft forwardly or backwardly in a longitudinal direction of the rotating shaft, whereby the second turning plate can move on the rotating shaft forwardly or backwardly in the longitudinal direction of the rotating shaft.

5. The apparatus according to claim 4, wherein the movable member is moved on the rotating shaft by at least one of a hydraulic force, a pneumatic force, and mechanical force.

6. The apparatus according to claim 4, wherein the first turning plate, the second turning plate, the insert protrusion or protrusions, the insert hole or holes, and the movable member form a set, and the apparatus comprises a plurality of the sets provided on the rotating shaft.

7. The apparatus according to claim 1, wherein the rotating shaft includes multiple sections, each of the multiple sections configured to be rotated independently.

8. The apparatus according to claim 1, further comprising a support for supporting the rotating shaft.

9. The apparatus according to claim 4, wherein the movable member moves forwardly or backwardly on the rotating shaft via two arms which are rotatably connected via a hinge and are configured to fold or stretch to move the movable member and the second turning plate.

* * * * *